US007686072B2

(12) United States Patent
Cannas

(10) Patent No.: US 7,686,072 B2
(45) Date of Patent: Mar. 30, 2010

(54) HEAT EXCHANGER AND METHODS OF PRODUCING THE SAME

(75) Inventor: Christian Cannas, Mandello Del Lario (IT)

(73) Assignee: Riello S.p.A., Legnago (IT)

( * ) Notice: Subject to any disclaimer, the term of this patent is extended or adjusted under 35 U.S.C. 154(b) by 278 days.

(21) Appl. No.: 11/702,177

(22) Filed: Feb. 5, 2007

(65) Prior Publication Data

US 2008/0185132 A1 Aug. 7, 2008

(51) Int. Cl.
*F28D 7/02* (2006.01)
*B21D 53/06* (2006.01)

(52) U.S. Cl. ..... 165/163; 165/183; 29/890.046

(58) Field of Classification Search ..... 165/163, 165/177, 181, 183; 29/890.046, 890.05, 29/890.054
See application file for complete search history.

(56) References Cited

U.S. PATENT DOCUMENTS 2,650,802 A * 9/1953 Huet ..... 165/165
3,692,104 A * 9/1972 Gerstmann ..... 165/163
4,548,262 A * 10/1985 Hull ..... 165/111
4,924,939 A * 5/1990 Kim ..... 165/172
5,598,709 A * 2/1997 Viegas et al. ..... 62/50.2
2005/0081549 A1 * 4/2005 Wu ..... 62/290

FOREIGN PATENT DOCUMENTS

EP 0758731 B1 2/1997
WO WO 2004/090434 A1 10/2004
WO WO 2005/028966 A1 3/2005

OTHER PUBLICATIONS

European Search Report mailed Dec. 20, 2005 in European Appln. No. 05107262.7-2301.

* cited by examiner

*Primary Examiner*—Teresa J Walberg
(74) *Attorney, Agent, or Firm*—Davidson Berquist Jackson & Gowdey LLP

(57) ABSTRACT

A heat exchanger for a gas boiler for producing hot water is provided with a casing extending along a first axis and through which combustion fumes flow; a tube along which water flows, and which is housed inside casing, and coils about the first axis to form a helix having a succession of turns; and deflecting means for directing the fumes between successive turns of a first helix portion in a first direction and between successive turns of a second helix portion in a second direction opposite to first direction; the tube forming the turns of the first helix portion has a first cross section and the tube forming the turns of the second helix portion has a second cross section different from the first cross section.

13 Claims, 3 Drawing Sheets

HEAT EXCHANGER AND METHODS OF PRODUCING THE SAME

The present invention relates to a heat exchanger.

More specifically, the present invention relates to a heat exchanger for a gas boiler for producing hot water.

BACKGROUND OF THE INVENTION

A gas boiler for producing hot water normally comprises a gas burner, and at least one heat exchanger through which combustion fumes and water flow. Some types of gas boilers, known as condensation boilers, condense the steam in the combustion fumes and transfer the latent heat in the fumes to the water. Condensation boilers are further divided into a first type, equipped with a first exchanger close to the burner, and a second exchanger for simply condensing the fumes; and a second type, equipped with only one heat exchanger which provides solely for thermal exchange along a first portion, and for both thermal exchange and fume condensation along a second portion.

International patent application WO 2004/090434 discloses a condensation or dual-function exchanger of the above type, which comprises a casing extending along a first axis and through which combustion fumes flow; a tube along which water flows, and which is housed inside said casing, and coils about the first axis to form a helix comprising a succession of turns; and deflecting means for directing the fumes between successive turns of a first helix portion in a first direction and between successive turns of a second helix portion in a second direction opposite to the first direction;

Tubes are often finned and/or provided with walls having asymmetric cross-sections so as to increase the heat exchange between water and fumes. However, in a heat exchanger of the above type, even though fins and/or particularly shaped walls may in crease the heat exchange when fumes flow in a first direction between adjacent turns, the same fins and/or particularly shaped walls may disfavour heat exchange when fumes flow in a second direction opposite to first direction.

SUMMARY OF THE INVENTION

It is an object of the present invention to provide a heat exchanger for a gas boiler for producing hot water, which is extremely effective in terms of heat exchange and overcome the aforementioned drawback.

According to the present invention, there is provided a heat exchanger characterised in that the tube forming the turns of said first helix portion has a first cross section, and the tube forming the turns of the second helix portion has a second cross section different from the first cross section.

In this way, the heat exchange can be optimised according to the directions of the fumes between turns.

The present invention also relates to a method of producing a heat exchanger.

According to the present invention, there is provided a method of producing a heat exchanger, as claimed in the attached Claims.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
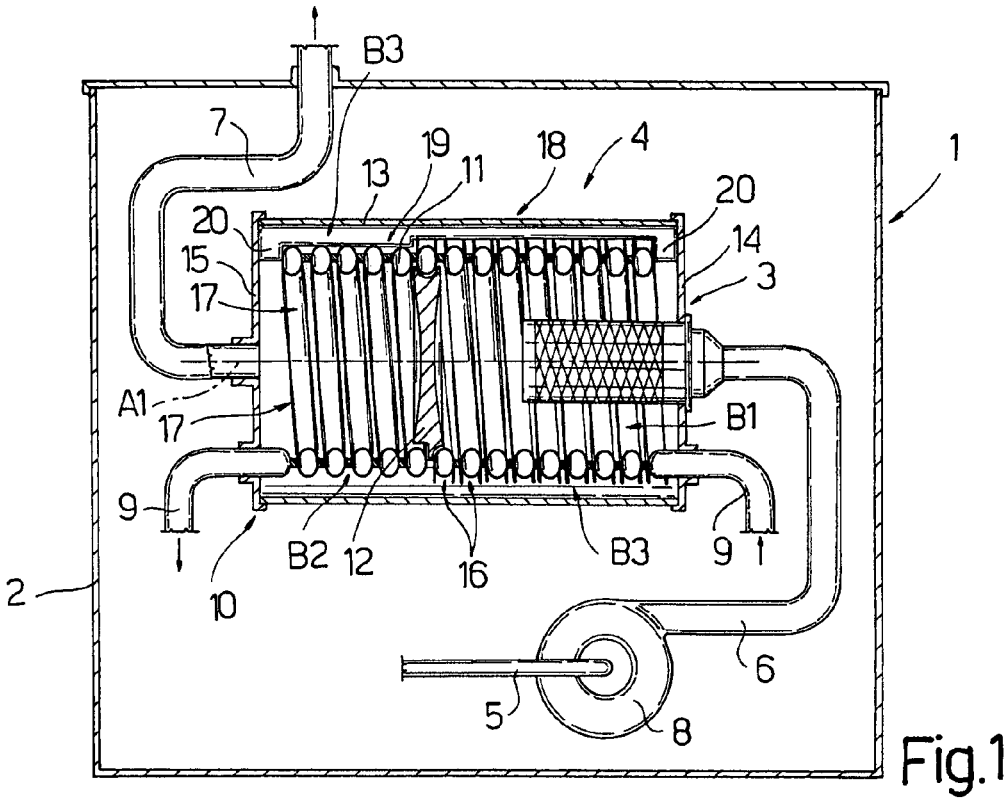
FIG. 1 shows a schematic front view, with parts in section and parts removed for clarity, of a gas boiler equipped with a heat exchanger in accordance with the present invention.

Number 1 in FIG. 1 indicates as a whole a gas boiler. Boiler 1 is a wall-mounted condensation boiler, i.e. in which the vapour in the combustion fumes is condensed, and comprises an outer structure 2 in which are housed a burner 3; a heat exchanger 4; a gas supply conduit 5; a pipe 6 for supplying an air-gas mixture to burner 3; a combustion gas exhaust pipe 7; a fan 8 connected to supply pipe 6, and which performs the dual function of supplying the air-gas mixture to burner 3, and expelling the combustion fumes; and a water circuit 9. Burner 3 is connected to pipe 6, is cylindrical in shape, and comprises a lateral wall with holes (not shown) for emitting the air-gas mixture and feeding the flame. Burner 3 is housed inside exchanger 4, which, in fact, also acts as a combustion chamber. Heat exchanger 4 is substantially cylindrical in shape, extends along a substantially horizontal axis A1, and comprises a casing 10, through which the combustion products flow; a finned tube 11, along which water flows; and a disk 12 for directing the fumes along a given path inside exchanger 4. Casing 10 comprises a cylindrical lateral wall 13 about axis A1; an annular wall 14 connected to lateral wall 13, and to burner 3; and an annular wall 15 connected to lateral wall 13, and to exhaust pipe 7. Burner 3 extends, coaxially with exchanger 4, inside of exchanger 4 for a given length. Tube 11 coils about axis A1 to form a succession of adjacent turns 16 forming a helix 17. Each turn 16 is located close to lateral wall 13, whereas helix 17 two opposite ends with known fittings (not shown) for connecting tube 11 to water circuit 9 outside exchanger 4. Disk 12 has a lateral rim so shaped so as to engage turns 16 and to screw into helix 17 in a position substantially perpendicular to axis A1.

Exchanger 4 comprises three spacers 18 for keeping turns 16 a given distance from lateral wall 13. As shown more clearly in FIG. 1, each spacer 18 comprises a straight portion 19 parallel to axis A1, and from which project two fingers 20 for clamping the helix 17.

Figure 2:
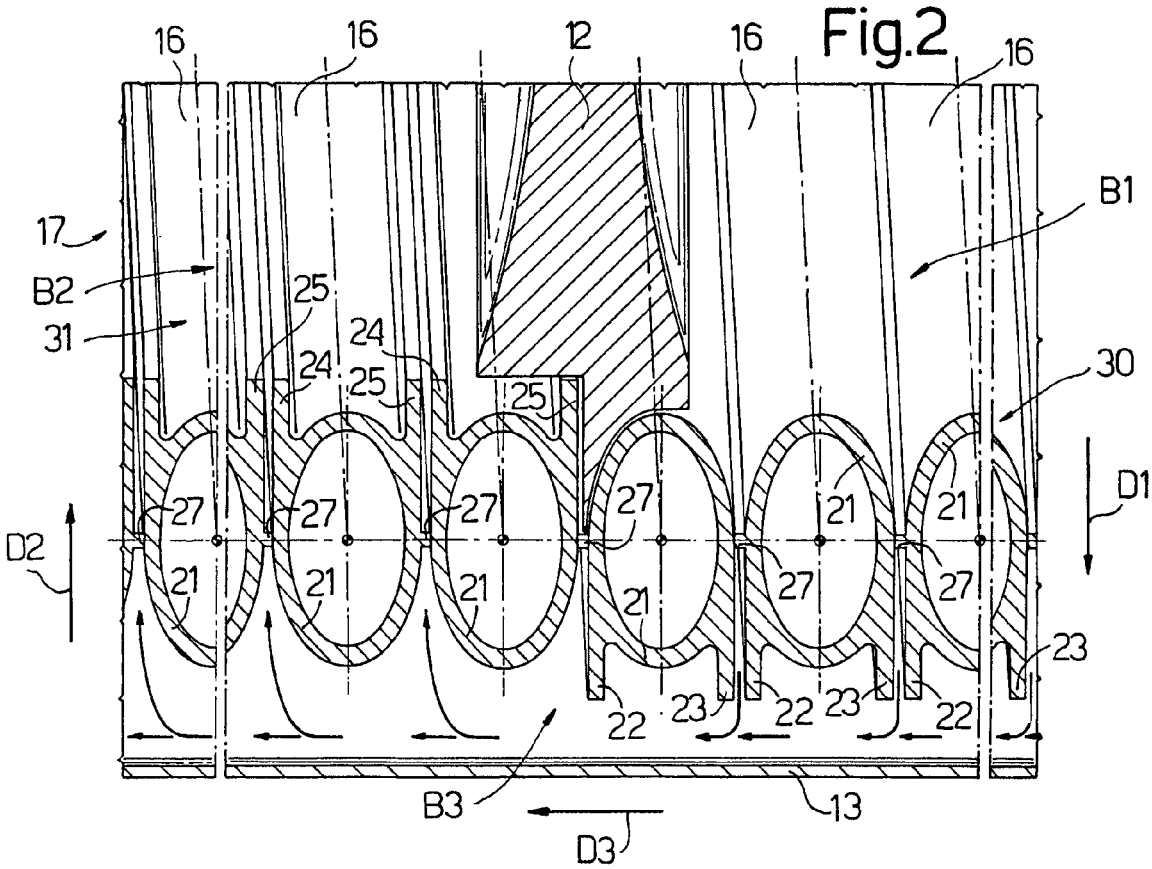
FIG. 2 shows a larger-scale section of a detail of the FIG. 1 heat exchanger.

As best shown in FIG. 2, helix 17, disk 12, and spacers 18 define, inside casing 10, a region B1 housing burner 3; a region B2 communicating directly with exhaust pipe 7; and three regions B3, each extending between two spacers 18, helix 17, and lateral wall 13. Combustion of the air-gas mixture takes place in region B1; and the resulting fumes, being prevented by disk 12 from flowing directly to region B2, flow between turns 16, in a direction D1 substantially perpendicular to axis A1 and directed outwardly with reference to axis A1, to regions B3, from which the fumes flow between turns 16 in direction D2 parallel and opposite direction D1 to region B2 and then along exhaust pipe 7. Along regions B3 fumes flow in a direction D3 substantially parallel to axis A1.

Figures 3, 4:
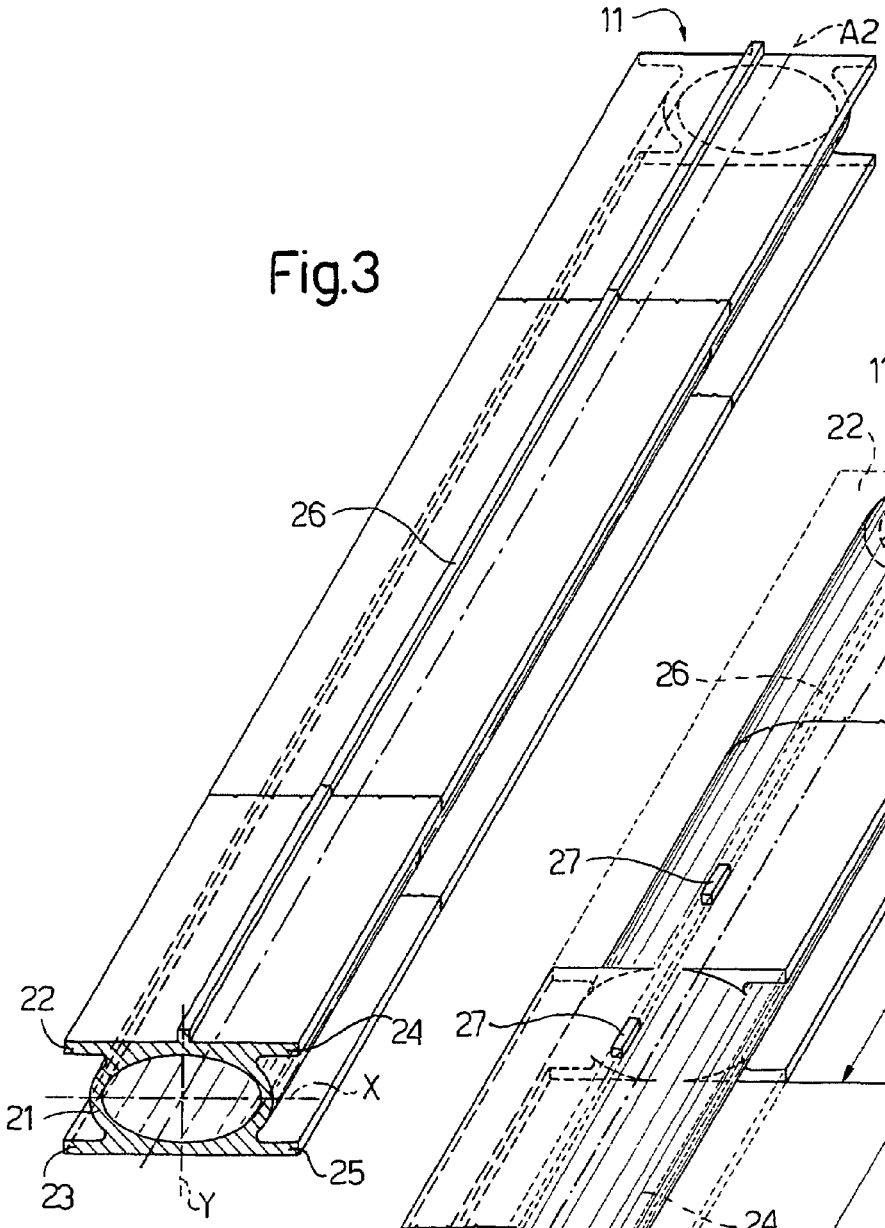
FIG. 3 shows a view in perspective of a finned tube used to produce the FIG. 1 exchanger.
FIG. 4 shows in perspective the FIG. 3 tube partly machined.

Tube 11 is preferably made of aluminium or aluminium based alloy. With reference to FIG. 3, finned tube 11 is an extruded tube, which extends along an axis A2, and has a wall 21 with an oval cross-section; two fins 22 and 23 on one side of tube 11 and two fins 24 and 25 on the side opposite to side of fins 22 and 23. The cross-section of tube 11 has a major axis X and a minor axis Y. Fins 22, 23, 24 and 25 are all parallel to axis A2 of tube 11 and to major axis X, and are therefore parallel to one another. Fins 22 and 24 are coplanar with each other, and tangent to the outer surface of wall 21. Fins 23 and 25 are arranged so that each fin 25 is coplanar with an opposite fin 23, and are tangent to the outer surface of wall 21. Tube 11 further comprises a longitudinal rib 26 parallel to axis A2 projecting form the outer surface of wall 21 from the intersection of the wall 21 with the minor axis Y.

With reference to FIG. 4, tube 11 is machined for removing part of the material of tube 11. In detail, rib 26 is partly machined so as to form a succession of teeth 27, preferably equally spaced, along outer surface of wall 21 in a direction parallel to axis A2. Furthermore, fins 22 and 23 are eliminated by machining along a tube section 28 of length L2, whereas fins 24 and 25 are eliminated by machining along a second section 29 of tube 11 of length L1. Then tube 11 is coiled in helix 17 about an axis. This operation actually comprises calendering tube 11, with the minor axis Y of the section of tube 11 maintained substantially parallel to the axis of helix 17 under formation. The three spacers 18 are then clamped on helix 17, which is inserted inside lateral wall 13 of casing 10. Annular walls 14 and 15 are then fitted to the opposite ends of cylindrical wall 13.

When helix 17 is clamped by spacers 18, teeth 27 of one turn 16 abut against wall 21 of the adjacent turn 16 so as to space turns 16 apart and to form gaps defining compulsory fume paths. Tube sections 28 and 29 define along helix 17 two portions 30 and 31: disk 12 is located substantially between portions 30 and 31.

Figures 5, 6:
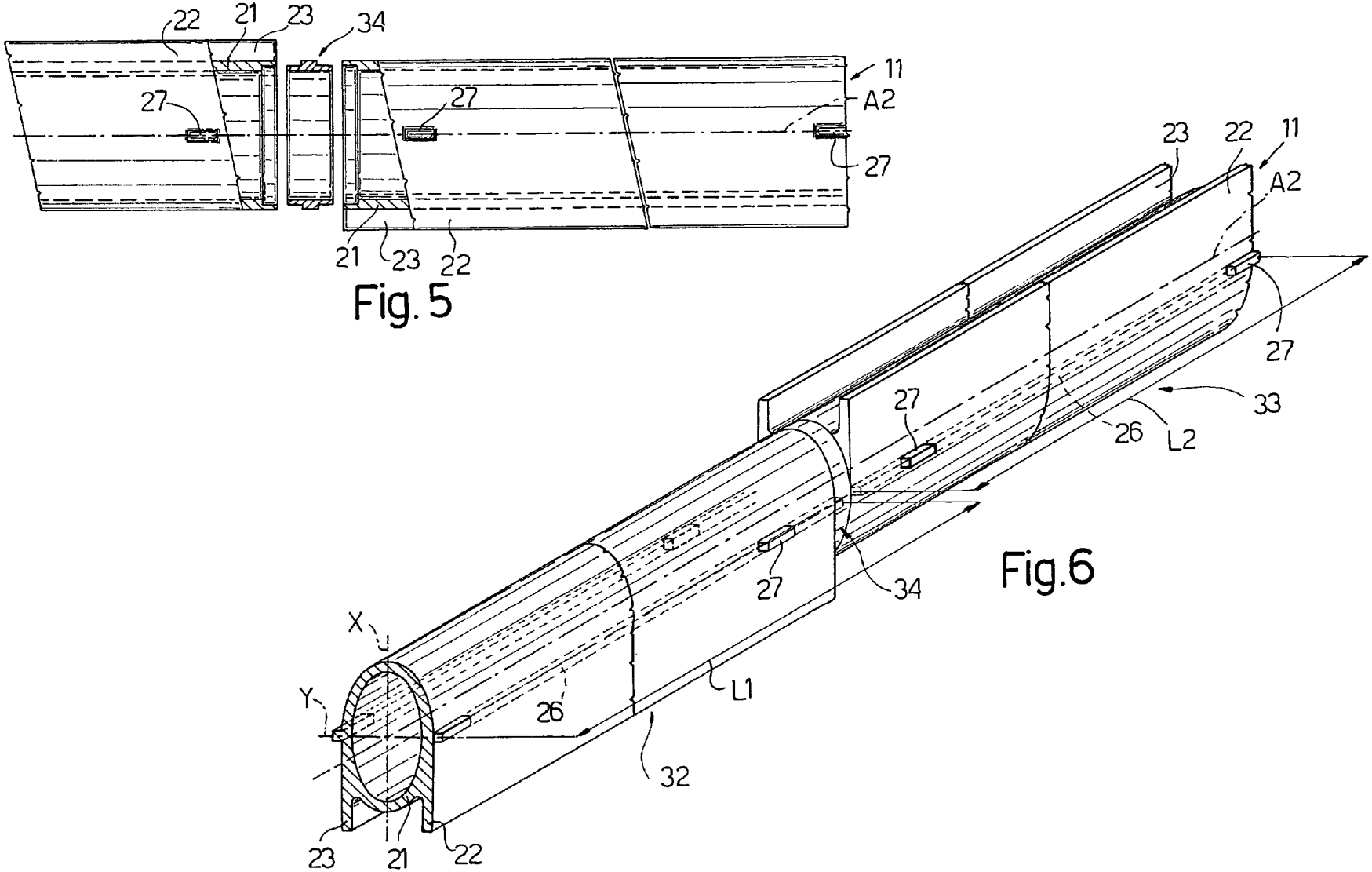
FIG. 5 shows in perspective finned tube sections used to produce the FIG. 1 heat exchanger.
FIG. 6 shows in perspective the tube sections of FIG. 5 in a united configuration.

With reference to the FIGS. 5 and 6 variation, the method for making the heat exchanger 4 comprises the steps of extruding a tube 11 provided only with fins 22 and 23 on the one side of the tube 11 and rib 26, cutting the tube 11 into two tube sections 32 and 33, rotating one tube section 32 with respect to the other tube section 33 of 180° about the longitudinal axis A2 of the tube 11 and further about an axis parallel to axis X, and joining the tube section 32 and 33 with the help of an intermediate connecting member 34. Once the two sections 32 and 33 are joined as shown in FIG. 6, sections 32 and 33 are coiled to form a helix 17 provided with a first helix portion 30 with outwardly directed fins 22 and 23, and a second helix portion 31 provided with inwardly directed fins 22, 23.

According to another variation, tube section 32 and 33 are separately coiled respectively in the first and second helix portions 31 and 32, which are joined together to form helix 17.

The method disclosed with reference to FIGS. 5 and 6 and its variation has the advantage of reducing the material consumption with respect to the method disclosed with reference to FIGS. 3 and 4.

Even though the embodiments disclosed in the description refer to finned tube, the present invention is not limited to the described embodiments. For example, this invention also applies to a tube without fins and having a cross-section asymmetric with respect to an axis of the same.

The invention claimed is:

1. A heat exchanger for a gas boiler for producing hot water; the heat exchanger comprising:

a casing extending along a first axis (A1) and through which combustion fumes flow;

a tube through which water flows, and which is housed inside said casing, and coils about the first axis (A1) to form a helix comprising a succession of turns; and a deflecting shield positioned internally of the helix at a point along the helix to direct the fumes between successive turns of a first helix portion in a first direction (D1) and between successive turns of a second helix portion in a second direction (D2) opposite to the first direction (D1);

wherein the tube includes first and second extruded tube sections, which have respective first and second coextruded longitudinal fins, respectively, forming turns of the first and second helix portions, and have respective first and second cross sections with the second cross section being different from the first cross section.

2. The heat exchanger according to claim 1, wherein said first and second cross section are equal in shape and dimensions, and are oriented opposite one another.

3. The heat exchanger as in claim 2 wherein the first and second sections are made from the same tube.

4. The heat exchanger as claimed in claim 1, wherein the turns of the first helix portion comprises two first fins extending only outwardly and the turns of the second helix portion are provided with two second fins extending only inwardly with respect to said helix.

5. The heat exchanger as claimed in claim 1, wherein each of the turns is provided with integrally made teeth protruding from a wall of the tube so as to space said turns apart and form gaps between adjacent turns.

6. A method of producing the heat exchanger (4) claimed in claim 1, characterized by coiling about an axis a first and second tube sections (28, 29, 32, 33) of said tube (11) so as to form respectively said first and second helix portions (30, 31); the first tube section (28, 32) being provided with said first cross section and said second tube section (29, 33) being provided with said second cross-section.

7. A method according to claim 6, characterized in that said tube (11) is extruded and extend along a second axis (A2).

8. A method according to claim 6, characterized in that said tube (11) is a finned tube comprising fins (22, 23, 24, 25) extending along the second axis (A2); the fins defining at least two axes (X, Y) of symmetry of the tube cross section; the method comprising the steps of machining some of the fins (22, 23, 24, 25) along a portion of length (L1) so as to define said first tube section (28) and machining the other fins (22, 23, 24, 25) along a portion of length (L2) so as to define said second tube section (29) before coiling said tube (11).

9. Method according to claim 7, characterized by extruding said tube (11) with a cross-section having at least an axis of asymmetry (Y); cutting said tube (11) into a first tube section (32) and into a second tube section (33); rotating said first tube section (32) with respect the second tube section (33) of an angle of 180° about said second axis (A2) and of an angle of 180° about an axis (X) perpendicular to the second axis (A2) and to said axis of asymmetry (Y); keeping said axis of asymmetry (Y) substantially parallel to axis of the helix (17) when coiling.

10. Method according to claim 9, characterized by joining said first and second tube sections (32, 33) before coiling to form said helix (17).

11. Method according to claim 9, characterized by coiling separately said first and second tube sections (32, 33) so as to form respectively said first and second helix portions (30, 31) and joining said first and second helix portions (30, 31) to form said helix (17).

12. A heat exchanger for a gas boiler for producing hot water, the heat exchanger comprising:

a casing extended along a first axis and through which combustion fumes flow, a tube through which water flows, and which is housed inside said casing, and coils about the first axis to form a helix comprising first and second helix portions defining a succession of spaced apart turns forming gaps between them; and wherein the tube includes first and second extruded tube sections, which form respectively the turns of said first and second helix portions, and have respectively a first asymmetric cross section, and a second asymmetric cross section different from the first asymmetric cross section; said first and second asymmetric cross sections being substantially equal in shape and dimensions, and oriented opposite one another.

13. A beat exchanger for a gas boiler for producing hot water; the heat exchanger comprising a tube through which water flows, which coils about an axis to form a helix comprising first and second helix portions defining a succession of spaced apart turns forming gaps between them; the gaps of the first helix portion being travelled by a heat exchange fluid in one direction and the gaps of the second portion extending in an opposite direction;

wherein the tube includes first and second extruded tube sections, which have respective first and second coextruded longitudinal fins, thereon and form, the turns of said first and second helix portions and having, respectively, a first cross section and a second cross section with the second cross section being different from the first cross section, said first and second cross sections being substantially equal in shape and dimensions, and oriented opposite one another, said first and second tube sections being joined to one another by an intermediate connecting member.

* * * * *